US006688480B1

(12) United States Patent
Denny

(10) Patent No.: US 6,688,480 B1
(45) Date of Patent: Feb. 10, 2004

(54) METHODS AND APPARATUS FOR TEMPORARILY BLOCKING ACCESS TO AISLE BETWEEN SHELVES

(75) Inventor: David S. Denny, Middle Haddam, CT (US)

(73) Assignee: SINCO, Inc., Middletown, CT (US)

( * ) Notice: Subject to any disclaimer, the term of this patent is extended or adjusted under 35 U.S.C. 154(b) by 0 days.

(21) Appl. No.: 10/157,001

(22) Filed: May 28, 2002

Related U.S. Application Data

(60) Provisional application No. 60/294,096, filed on May 29, 2001, and provisional application No. 60/294,095, filed on May 29, 2001.

(51) Int. Cl.[7] ..... A47F 5/00
(52) U.S. Cl. ..... 211/180
(58) Field of Search ..... 211/180, 183; 49/55, 50, 372; 160/23.1, 24, 354, 368.1

(56) References Cited

U.S. PATENT DOCUMENTS

| | | | | | |
|---|---|---|---|---|---|
| 376,436 | A | * | 1/1888 | Harrison | 160/24 |
| 5,275,220 | A | * | 1/1994 | Siegal | 160/24 |
| 5,690,317 | A | * | 11/1997 | Sandsborg | 256/1 |
| 6,142,701 | A | * | 11/2000 | Falcon | 404/6 |
| 6,435,250 | B1 | * | 8/2002 | Pichik et al. | 160/24 |
| 6,536,502 | B2 | * | 3/2003 | Britto et al. | 160/23.1 |

* cited by examiner

*Primary Examiner*—Alvin Chin-Shue
*Assistant Examiner*—Sarah Purol
(74) *Attorney, Agent, or Firm*—IPLM Group, P.A.

(57) ABSTRACT

A retractable barrier assembly is selectively deployed to span an aisle bounded on at least one side by a shelf unit. More specifically, a net is preferably movable between a storage position, off the floor and free of the aisle, and a deployed position, extending across the aisle. A container is preferably provided to support a first end of the net and house the net when in its storage position.

43 Claims, 7 Drawing Sheets

METHODS AND APPARATUS FOR TEMPORARILY BLOCKING ACCESS TO AISLE BETWEEN SHELVES

This application claims benefit of Ser. No. 60/294,096 filed May 29, 2001, and also claims benefit of Ser. No. 60/294,095 filed May 29, 2001.

FIELD OF THE INVENTION

The present invention relates to methods and apparatus for selectively blocking access to an aisle that extends between first and second shelving assemblies.

BACKGROUND OF THE INVENTION

Various items are stored on shelves in all sorts of applications and environments, and aisles typically run or extend between opposing rows of shelves to provide access to the shelves and their contents. Under such circumstances, anyone who walks down the aisle is at risk of being struck by an item falling from one of the shelves. This potential hazard increases when items are being loaded on and off the shelves, usually by means of a forklift. With the increased popularity of warehouse type retail outlets, the potential hazard increases further because of increased traffic and/or the less attentive behavior on the part of consumers within a warehouse environment. In view of the foregoing, an object of the present invention is to provide methods and/or apparatus for temporarily blocking access to one or more aisles that extend between shelves or along a shelf, so that loading and unloading of the shelves may take place without exposing people to the threat of injury associated therewith. Ideally, such arrangements should be relatively inexpensive to manufacture, relatively easy to install and use, and reliable in use.

SUMMARY OF THE INVENTION

The present invention may be described in terms of providing a selectively "deployable" net. In a preferred application, a first end of a net is secured to a first shelf assembly, and the net is movable between a storage position and an active position. When in the storage position, the net is supported by the first shelf assembly in a manner that does not touch the floor or interfere with access to any aisle. When the net is moved to the active position, an opposite, second end of the net is secured to an opposing, second shelf assembly in a manner that blocks or spans an aisle extending between the second shelf assembly and the first shelf assembly.

A preferred embodiment of the present invention includes a container that is mounted on the first shelf assembly. A door on the container provides access to a compartment inside the container. The first end of the net is preferably anchored inside the compartment, and the entire net is preferably stored inside the compartment when not in use. Many features and/or advantages of the present invention will become more apparent from the detailed description which follows.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
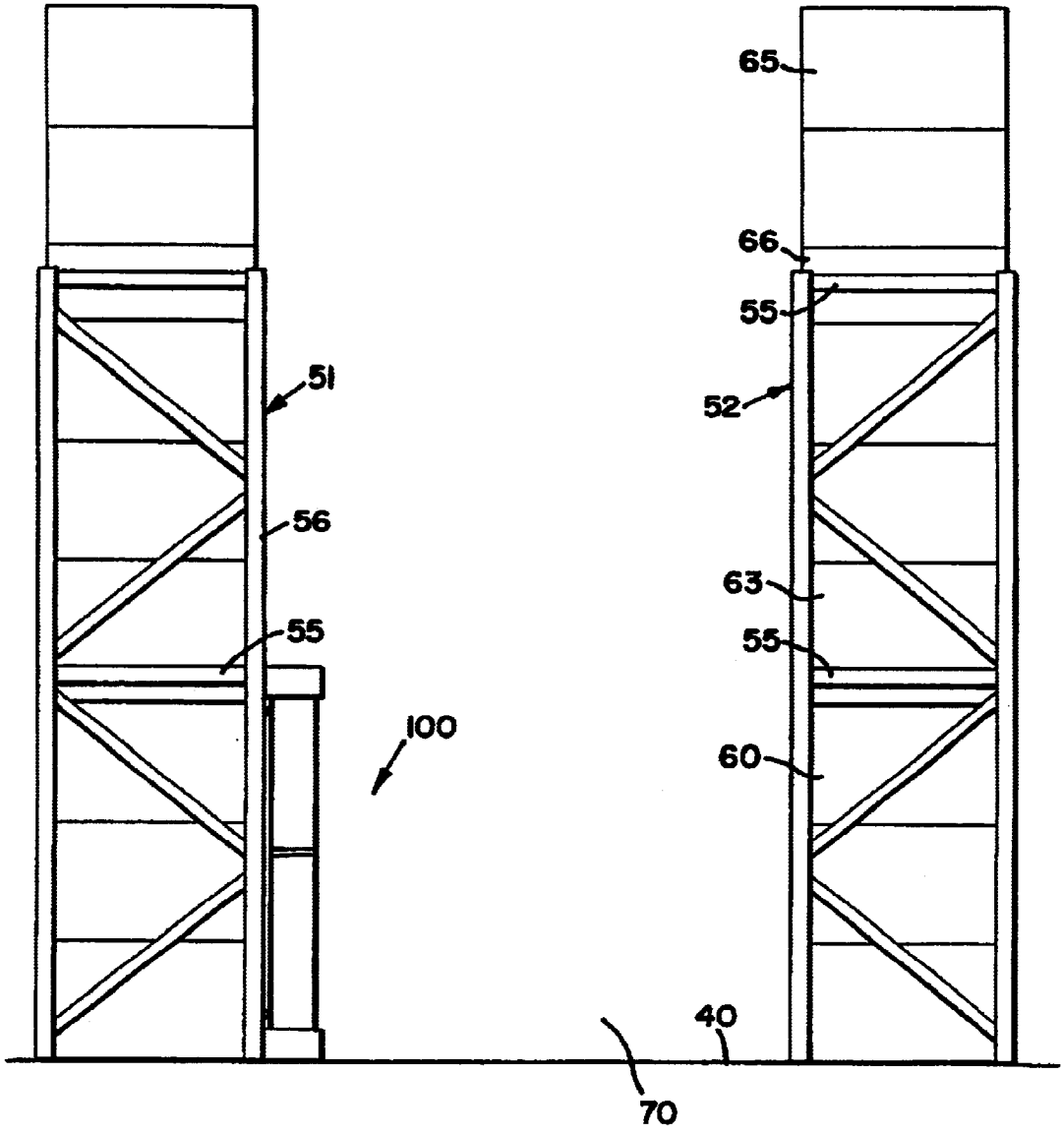
FIG. 1 is an end view of an aisle that extends between two rows of shelf units in a warehouse type storage arrangement, with one of the shelf units supporting a retractable barrier system constructed accordingly to the principles of the present invention.
Figure 2:
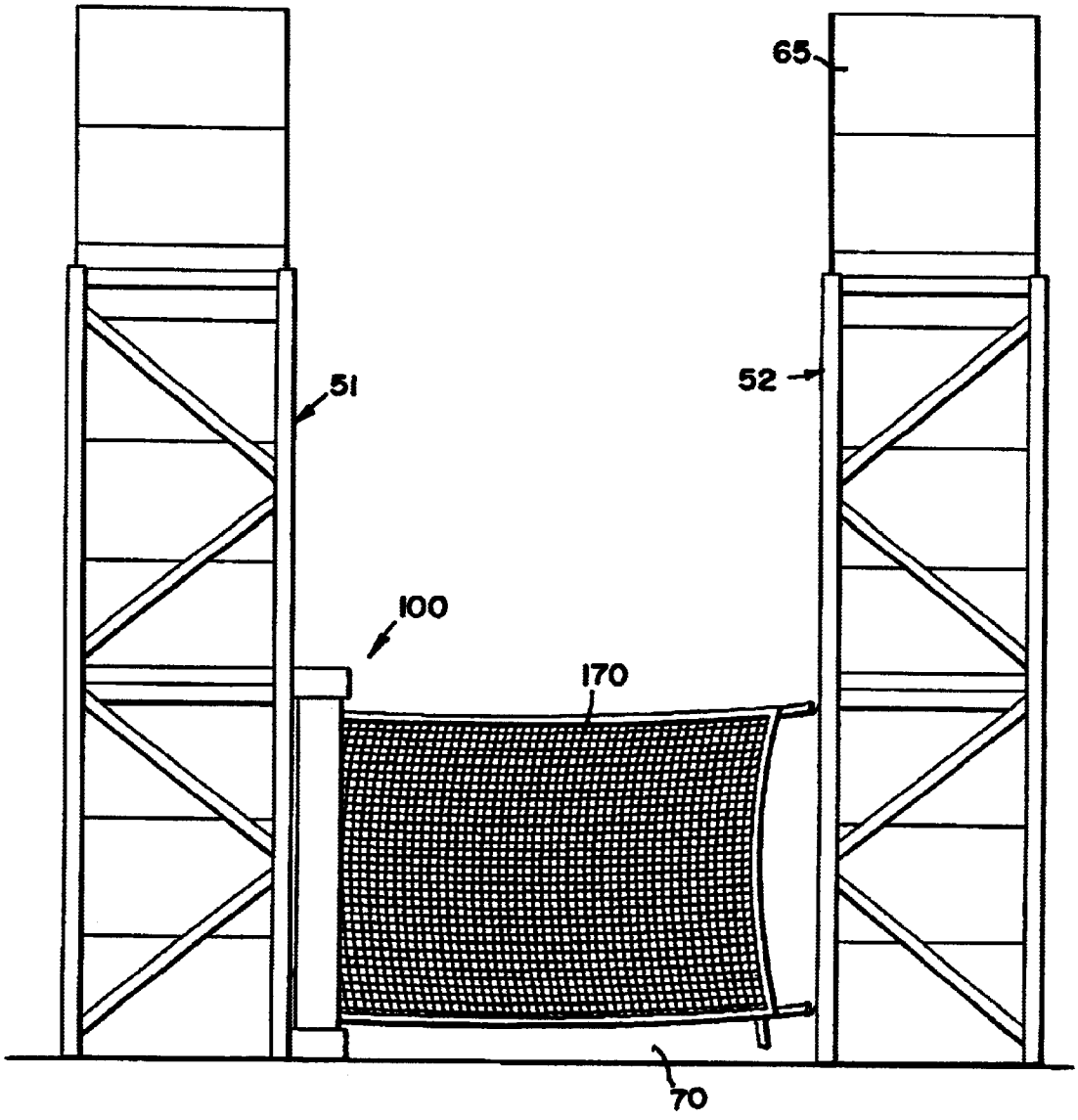
FIG. 2 is the same end view of the aisle and shelf units of FIG. 1, with the retractable barrier system deployed to block access to the aisle.

As suggested by FIGS. 1–2, the present invention may be used in connection with, and described with reference to first and second shelving units 51 and 52, and an aisle 70 that extends therebetween. More specifically, the present invention provides a retractable net assembly 100 that transforms between a first configuration, leaving the aisle 70 open or accessible, as shown in FIG. 1, and a second configuration, with a net 170 spanning or blocking access to the aisle 70, as shown in FIG. 2. In other words, the present invention provides a net 170 that is ready for deployment in the manner shown in FIG. 2 whenever it is deemed necessary to block the aisle 70.

Each shelf assembly 51 and 52 includes vertical support posts 56, and horizontal shelves 55 that are supported by the posts 56 in a manner known in the art. In this regard, the posts 56 preferably have keyhole-shaped openings disposed in columns along the length thereof. Each opening has an upper portion that is circular, and a lower portion that is a relatively narrower slot. Products and/or boxes may be stored directly on an underlying floor surface 40 (like the boxes designated as 60); directly on the shelves 55 (like the boxes designated as 63); and/or on pallets 66 that rest on the shelves 55 or the floor surface 40 (like the boxes designated as 65).

FIGS. 3–7 show a retractable net assembly 100 and/or various components thereof in relatively greater detail. The assembly 100 includes a cylindrical tube 110 that is fitted with upper and lower end caps 120 and 121, and provided with a door 112 for purposes of limiting access to the interior of the tube 110. The door 112 is preferably mounted on the tube 110 by means of hinges 114, and the door 112 is preferably latched in a closed position by means of mating strips 116 and 118 of hook-and-loop type fasteners. In the alternative, a locking arrangement may be provided to limit access to authorized personnel, and/or the door may be alternatively mounted on the "loose" end of the net and selectively movable therewith into engagement with the opposing shelf assembly.

Figure 6:
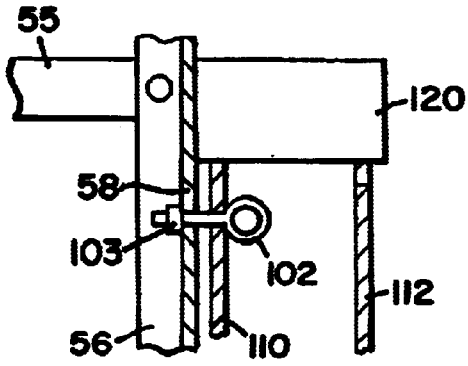
FIG. 6 is a partially sectioned, side view of a portion of the retractable barrier system of FIGS. 3–5, as mounted on one of the shelf units of FIG. 1.

On the preferred embodiment 100, holes 111 extend through the back of the tube 110 (opposite the door 112) to facilitate mounting of the assembly 100 to a shelf post 56. As shown in FIG. 6, a fastener 102 extends through the hole 111 in the tube 110 and an aligned hole 58 in the post 56, and is threaded into a nut 103. On the embodiment shown in FIG. 6, the shaft of the fastener 102 is configured to fit within the slot portion of the opening 58, and the nut 103 is configured to fit through the circular portion of the opening 58. As a result, the entire assembly 100 may be readily lifted from the post 56 and transported to another shelf unit (and thus, a dedicated assembly 100 is not necessarily required for each aisle 70). In the alternative, the shaft of the fastener 102 may be configured to occupy the circular portion of the opening 58, thereby anchoring the tube 110 in place.

The fastener 102 is preferably an eye-bolt for reasons described below. Those skilled in the art will recognize that the fastener 102 may also be inserted through a spacer (not shown) that may be disposed between the tube 110 and the post 56 (and preferably secured to the tube 110) for purposes of occupying the offset defined by the end cap 120 relative to the outside wall of the tube 110.

Figure 7:
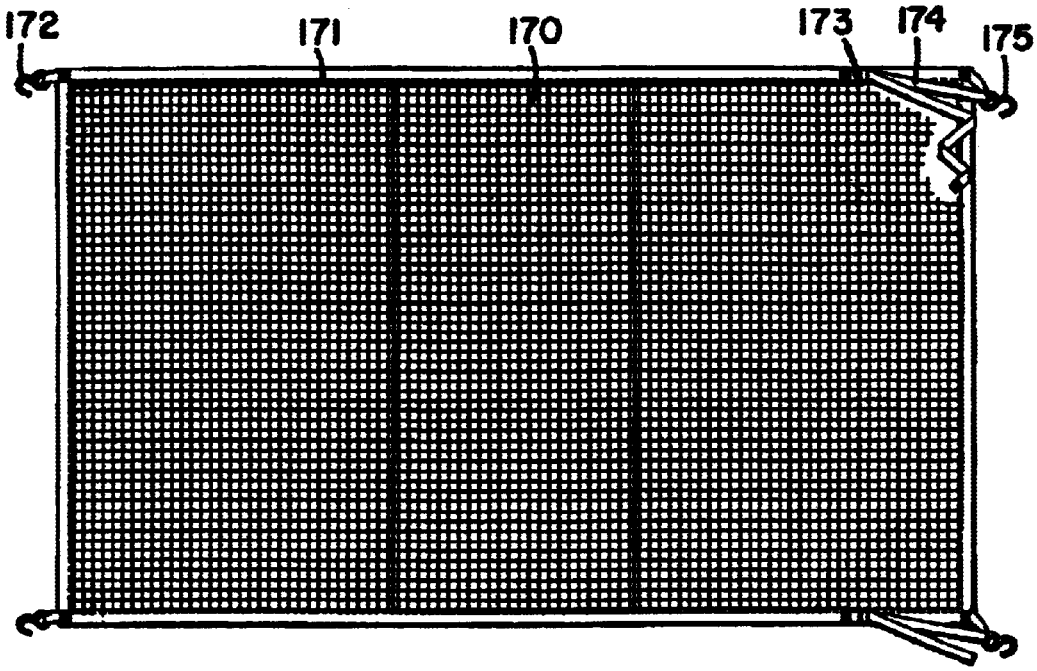
FIG. 7 is a front view of a net that forms part of the retractable barrier system shown in FIGS. 1–5.

As shown in FIG. 7, the net 170 includes overlapping horizontal and vertical strands that are interconnected at their points of intersection and cooperate to define square openings therebetween. A border 171 is secured about the perimeter of the net 170, preferably by folding the border 170 about the edge of the net 170 and stitching through both the overlapping portions of the border 171 and intervening openings in the net 170. At one end of the net 170, upper and lower hooks 172 are secured to respective corners of the border 171. At an opposite, "deployable" end of the net 170, upper and lower hook assemblies are secured to respective portions of the border 171. Each hook assembly includes a buckle 173 secured to a respective portion of the border 171; a strap 174 secured to a respective corner of the border 171 and inserted through a respective buckle 173; and a hook 175 secured to an intermediate portion of a respective strap 174 (between the buckle 173 and the corner of the border 171). The buckles 173 operate in a manner known in the art to releasably clamp a portion of a respective strap 174. As a result, the hooks 175 are adjustably mounted on the net 170 to accommodate some variation in the width of the aisle 70 (7–9 feet across on the preferred embodiment).

Figure 4:
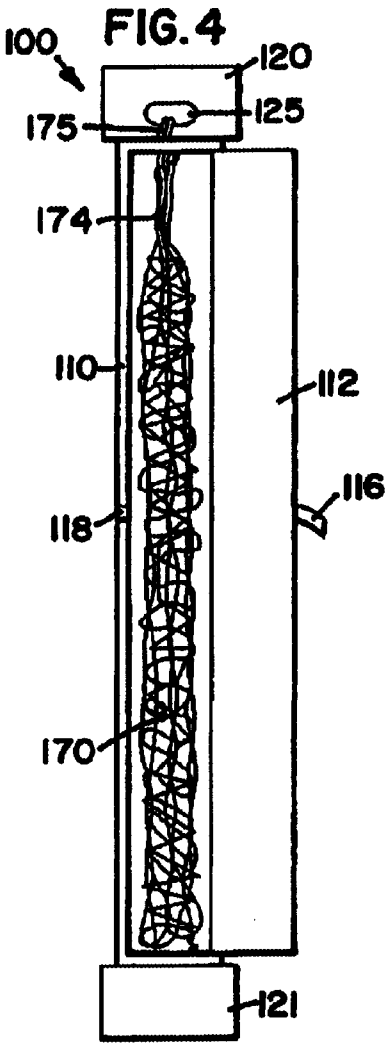
FIG. 4 is a front view of the retractable barrier system of FIG. 3 in a second, open configuration.
Figure 3:
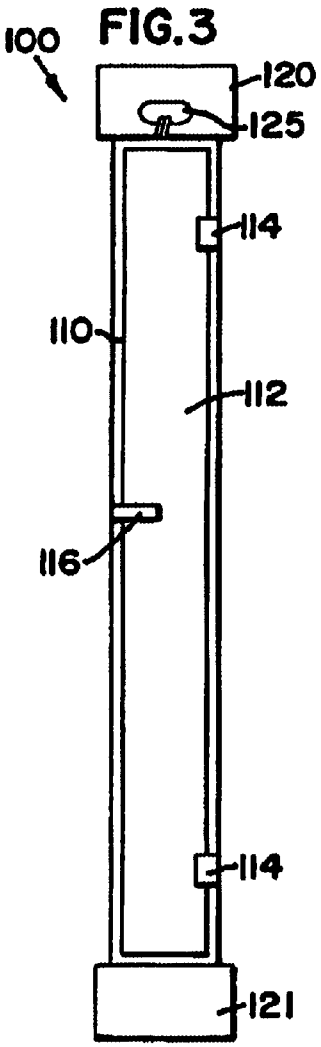
FIG. 3 is a front view of the retractable barrier system of FIG. 1 in a first, closed configuration.
Figure 5:
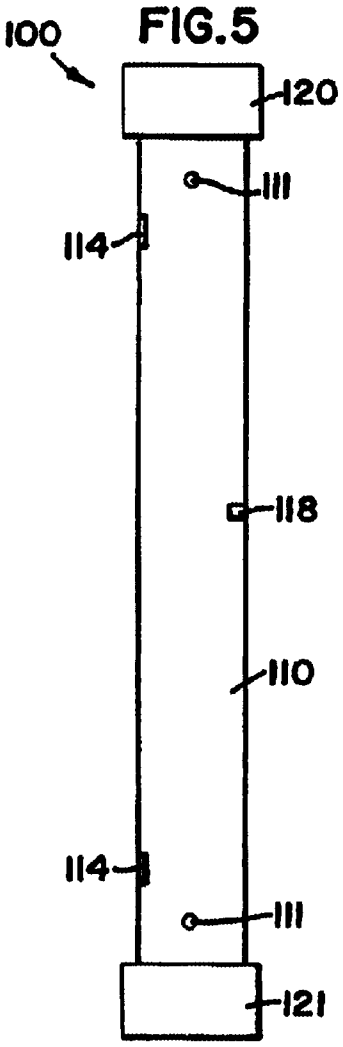
FIG. 5 is a rear view of the retractable barrier system of FIG. 3.

Each of the hooks 172 is secured to a respective fastener 102 or otherwise secured inside the tube 110. Among other things, those skilled in the art will recognize that net supports may alternatively be provided apart from the tube fasteners. On the opposite, "deployable" end of the net, each of the hooks 175 is available for insertion into a respective opening in a post 56 disposed across the aisle 70 from the tube 110. Also, an opening 125 is provided in the upper end cap 120 to accommodate both of the hooks 175 when the net 170 is stored within the tube 110 (as shown in FIG. 4).

The present invention may also be described in terms of various features and/or functions. For example, the assembly 100 may be said to include a means (fasteners 102) for continually supporting a first end of the net 170 relative to a first shelf unit, and a means (opening 125) for temporarily supporting a second end of the net 170 off the floor 40 and in close proximity to the first shelf unit. The term "close proximity" shall be construed to mean within one foot of the "anchoring" or base shelf unit.

Figures 8, 9:
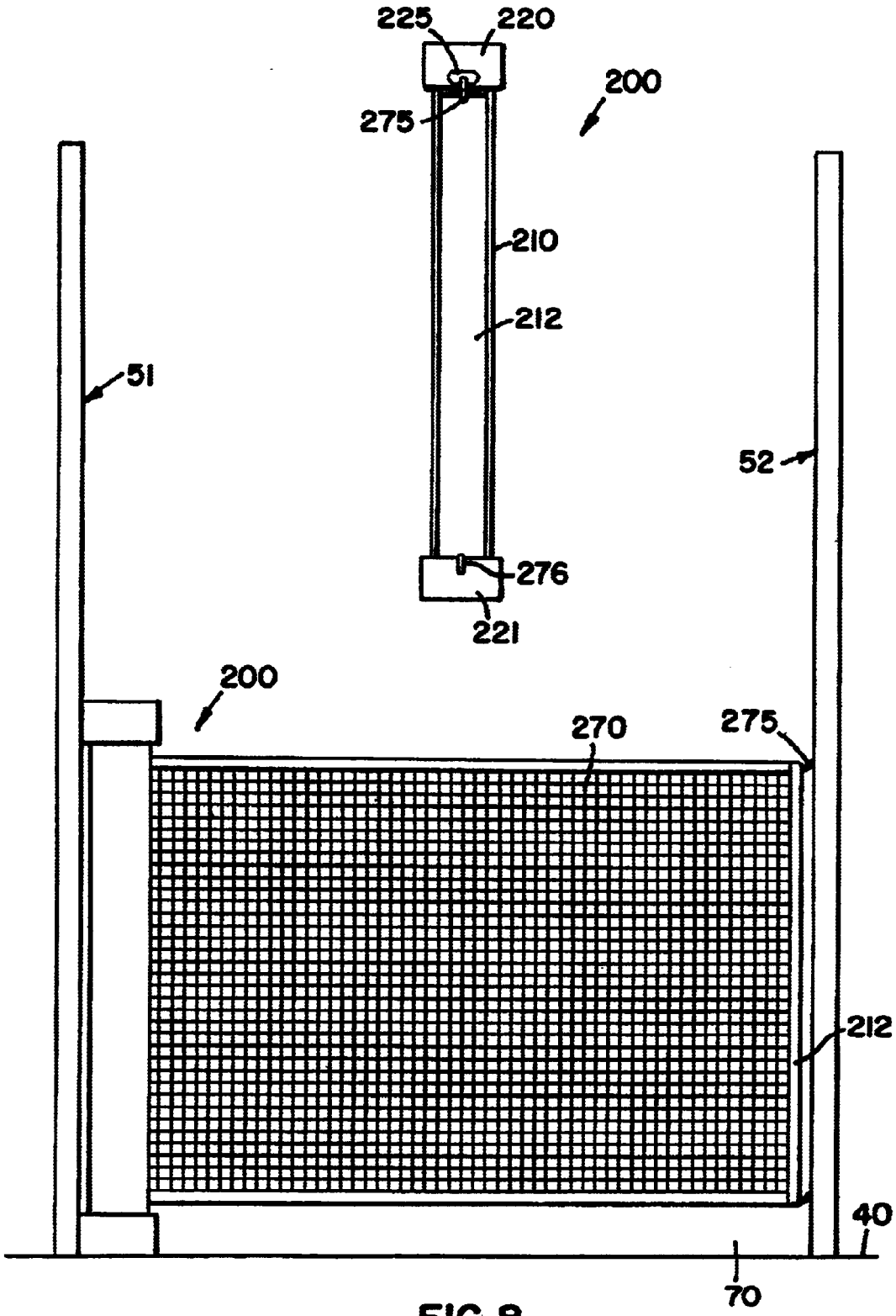
FIG. 8 is an end view of another retractable barrier system constructed accordingly to the principles of the present invention, and suitable for use in connection with the shelf units of FIG. 1.
FIG. 9 is a front view of the retractable barrier system of FIG. 8.

The present invention may also be described with reference to alternative embodiments. For example, FIGS. 8–9 show a retractable barrier system 200 having a temporary supporting means that includes a rigid support 212 extending along the "deployable" edge of the net 270. The support 212 is provided with hooks 275 and 276 at its corners to engage a support post on the shelf unit 52. When the net 270 is not in use, the support 212 may be hooked to the tube 210 or another appropriate container, and may even serve as a door that limits access to the interior of the container 210. In this regard, the support 212 may be cut from the tube 210 and thus, be inherently configured to span the opening in the tube 210. An opening 225 is provided in the upper end cap 220 to receive the hook 275, and a groove is provided in the lower end cap 221 to receive the hook 276.

Figures 10, 11:
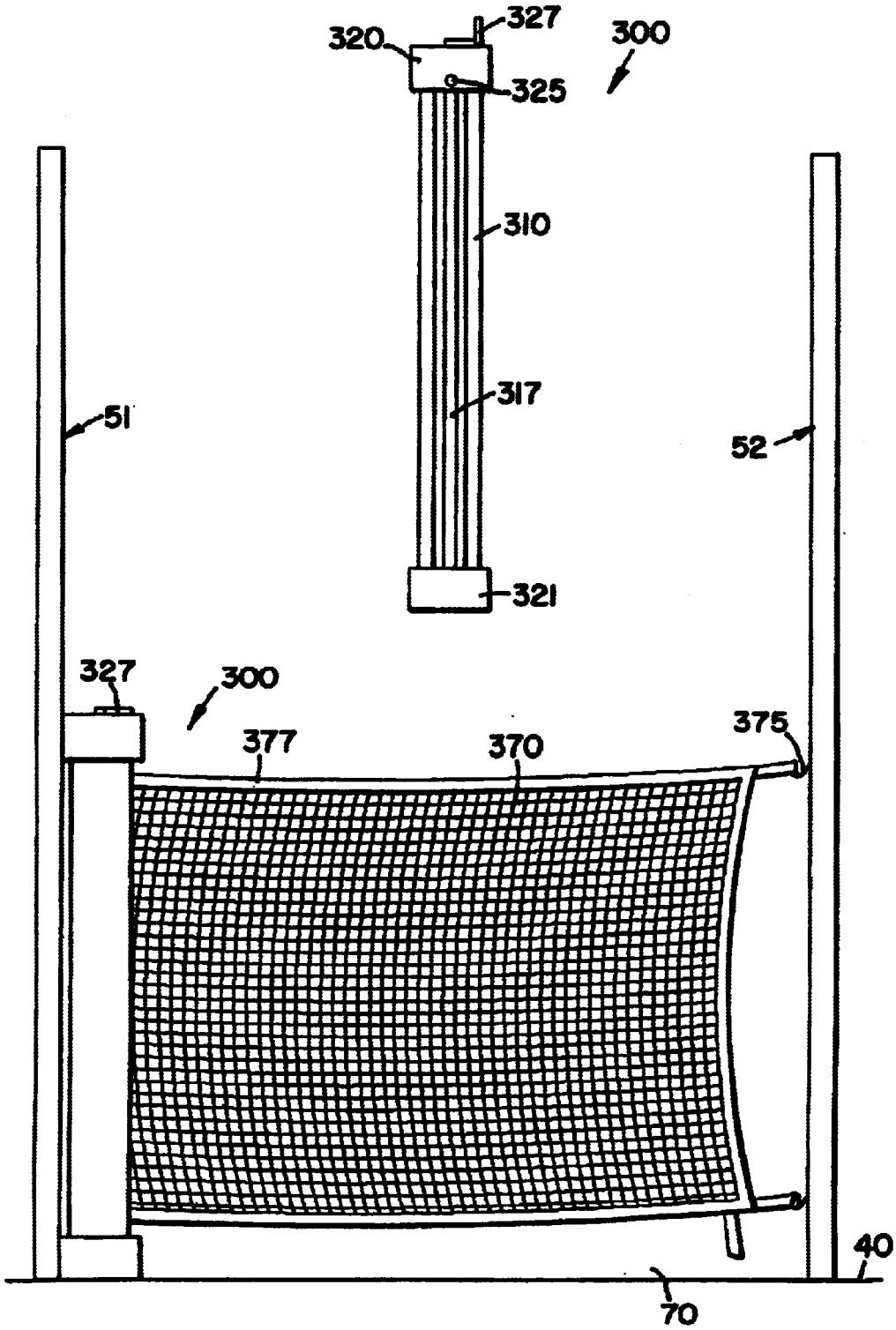
FIG. 10 is an end view of yet another retractable barrier system constructed accordingly to the principles of the present invention, and suitable for use in connection with the shelf units of FIG. 1.
FIG. 11 is a front view of components of the retractable barrier system of FIG. 10.

FIGS. 10–11 show a retractable barrier system 300 with a means for winding the net 370 about a shaft 317 for storage purposes, and unwinding the net 370 from the shaft 317 for deployment purposes. The shaft 317 extends the length of the tube 310 and is accessible via an elongate slot in the tube 310. A crank handle 327 is pivotally mounted to a crank arm, which in turn, is rigidly connected to the shaft 317. The handle 317 is pivoted to the position shown in FIG. 11 to facilitate winding of the net 370 about the shaft 317. While winding the net 370 onto the shaft 317, a person should maintain the upper border segment 377 in proximity to the upper end cap 320. An opening 325 is provided in the upper end cap 320 to receive the hook 375 (and a similar opening may be provided in the lower end cap 321).

Figures 12, 13:
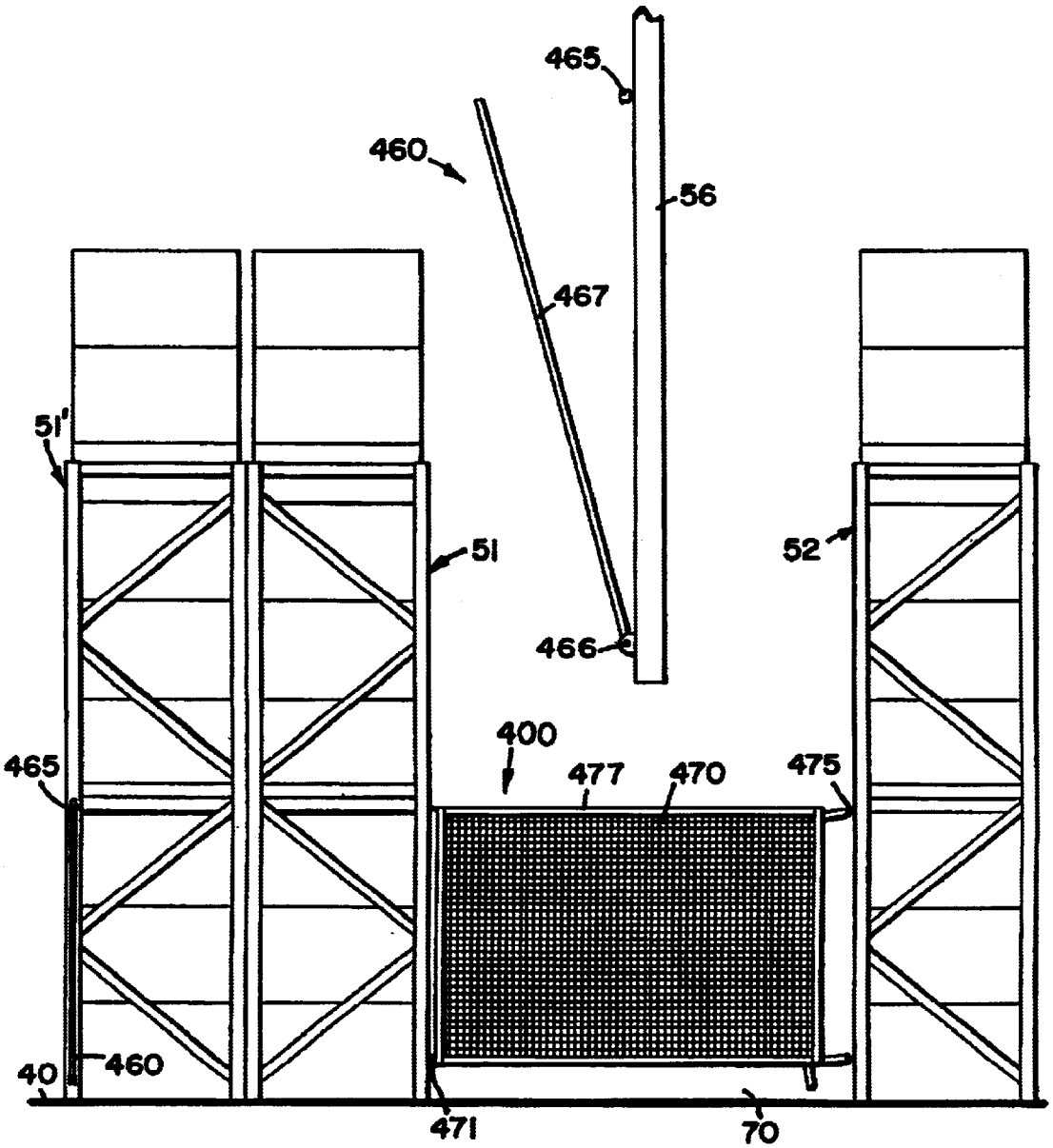
FIG. 12 is an end view of still another retractable barrier system constructed accordingly to the principles of the present invention, and suitable for use in connection with the shelf units of FIG. 1.
FIG. 13 is an enlarged front view of components of the retractable barrier system of FIG. 12.

FIGS. 12–13 show a retractable barrier system 400 having a bar 467 on an opposite side of the base shelf unit (51 and 51') to support the net 470 in a folded storage configuration. With reference to FIG. 13, a U-shaped clip 465 is mounted on the post 56 to receive an upper end of the bar 467 by snap fit, and a trunnion 466 is mounted on the post 56 to pivotally support a lower end of the bar 467. The anchored end of the net 470 is secured to the shelf unit 51 by means of hooks 471. When the net 470 is deployed, the opposite end of the net 470 is connected to the shelf unit 52 by means of hooks 475. When storage of the net 470 is desired, the net 470 is pulled taut over the trunnion 466 and between the bar 467 and the associated post 56. A proximate portion of the upper border segment 477 is then rested on top of the clip 465, and the bar 467 is snapped into place relative to the clip 465. The deployable end of the net 470 is then folded about the bar 467 and back toward the hooks 471. The hooks 475 are then connected to respective portions of the net 470 in a manner that maintains the folded net 470 as taut as possible.

The present invention may also be described in terms of various methods (with reference, for example, to the depicted embodiments). Among other things, the present invention provides a method of controlling access to a first shelf assembly and a second shelf assembly, comprising the steps of arranging each said shelf assembly on a floor surface in a manner that defines an aisle therebetween; providing a net; providing an anchoring means for anchoring a first end of the net to the first shelf assembly; and providing a connecting means for selectively connecting an opposite, second end of the net to the first shelf assembly in a manner that maintains the net off the floor surface and in close proximity to the first shelf assembly, and for alternatively connecting the second end of the net to the second shelf assembly in a manner that blocks access to the aisle. The anchoring means may be provided in the form of hooks on the net, and/or may be further include a means for housing the net when in its storage position. The connecting means may also be provided in the form of hooks on the net, and/or may further include a means for enclosing the net when in its storage position, a means for winding the net about itself for storage purposes, or a means for folding the net about itself for storage purposes.

The present invention also provides a method of selectively controlling access to an aisle that extends between a first shelf assembly and a second shelf assembly, comprising the steps of providing a net support; mounting the net support on the first shelf assembly; providing a net; connecting a first end of the net to the net support; securing a discrete portion of the net to at least one of the net support and the first shelf assembly in a manner that keeps the net off the floor and in close proximity to the first shelf assembly; and selectively connecting the second end of the net to the second shelf assembly to span the aisle in a manner that blocks access to the aisle. The mounting step and/or the connecting step may be facilitated by providing hooks on the net.

The present invention also provides a method of selectively controlling access to an aisle that extends between a first shelf assembly and a second shelf assembly, each of the type having horizontal shelves supported by vertical supports, comprising the steps of: providing a container with a compartment that is accessible via a door; mounting the container on one of the vertical supports on the first shelf assembly; providing a net; anchoring a first end of the net inside the compartment; maneuvering the net into the compartment; temporarily connecting an opposite, second end of the net to the container; closing the door with the net inside the compartment to conceal the net and leave the aisle accessible; and selectively opening the door, disconnecting the second end of the net from the container, and connecting the second end of the net to one of the vertical supports on the second shelf assembly to span the aisle and block access to the aisle.

The foregoing embodiments and methods, as well as their respective features, may be mixed and matched in various ways, as suggested by the use of common suffixes in the associated reference numerals. Moreover, this disclosure will enable persons skilled in the art to derive additional embodiments, improvements, and/or applications which similarly incorporate the essence of the present invention. Accordingly, the scope of the present invention should be limited only to the extent of the following claims.

What is claimed is:

1. A method of selectively controlling access to an aisle that extends between a first shelf assembly and a second shelf assembly, each of the type having horizontal shelves supported by vertical supports, comprising the steps of:

providing a container with a compartment that is accessible via a door;

mounting the container on one of the vertical supports on the first shelf assembly;

providing a net;

anchoring a first end of the net inside the compartment;

maneuvering the net into the compartment;

temporarily connecting an opposite, second end of the net to the container;

closing the door with the net inside the compartment to conceal the net and leave the aisle accessible; and selectively opening the door, disconnecting the second end of the net from the container, and connecting the second end of the net to one of the vertical supports on the second shelf assembly to span the aisle and block access to the aisle.

2. The method of claim 1, wherein a common fastener is used to mount the container on said one of the vertical supports and to anchor the first end of the net inside the compartment.

3. The method of claim 2, wherein the common fastener is an eye-bolt, and the anchoring step involves insertion of a hook on the net through an opening in the eye-bolt.

4. The method of claim 1, wherein at least one hook is mounted on the net to engage the second shelf assembly for purposes of connecting the second end of the net to said one of the vertical supports on the second shelf assembly.

5. The method of claim 4, wherein a discrete opening is provided in the container for purposes of temporarily connecting the opposite, second end of the net to the container.

6. A method of selectively controlling access to an aisle that extends between a first shelf assembly and a second shelf assembly, each of the type having horizontal shelves supported by vertical supports, comprising the steps of:

providing a net support;

mounting the net support on the first shelf assembly;

providing a net;

connecting a first end of the net to the net support;

securing a discrete portion of the net to at least one of the net support and the first shelf assembly in a manner that keeps the net off the floor and in close proximity to the first shelf assembly; and selectively connecting the second end of the net to the second shelf assembly to span the aisle in a manner that blocks access to the aisle.

7. The method of claim 6, wherein the securing step involves gathering the net into a bundle, and maneuvering the bundle into a container.

8. The method of claim 6, wherein the securing step involves winding the net about itself.

9. The method of claim 6, further comprising the step of selectively relocating the net support by pulling the net support upward and then away from the first shelf assembly.

10. The method of claim 6, wherein adjustable length hook assemblies are provided on the second end of the net for purposes of selectively connecting the second end of the net to said one of the vertical supports on the second shelf assembly.

11. A method of controlling access to a first shelf assembly and a second shelf assembly, comprising the steps of:

arranging each said shelf assembly on a floor surface in a manner that defines an aisle therebetween;

providing a net;

providing an anchoring means for anchoring a first end of the net to the first shelf assembly; and providing a connecting means for selectively connecting an opposite, second end of the net to the first shelf assembly in a manner that maintains the net off the floor surface and in close proximity to the first shelf assembly, and for alternatively connecting the second end of the net to the second shelf assembly in a manner that blocks access to the aisle.

12. The method of claim 11, wherein the anchoring means is provided as hooks mounted on respective upper and lower corners of the first end of the net.

13. The method of claim 12, wherein the connecting means is provided as hooks adjustably mounted on respective upper and lower corners of the second end of the net.

14. The method of claim 11, wherein the connecting means is provided as hooks adjustably mounted on respective upper and lower corners of the net.

15. The method of claim 11, further comprising the step of mounting a container on the first shelf assembly to house the net in its storage position.

16. The method of claim 15, wherein the container is provided as a cylindrical tube having a door that opens and closes relative thereto.

17. The method of claim 11, further comprising the steps of providing an elongate rigid member; securing the first end of the net to the rigid member; and providing a means for releasably mounting the rigid member on the first shelf assembly.

18. The method of claim 17, wherein the rigid member is provided as a container sized and configured to house the net in its storage position.

19. The method of claim 11, wherein the connecting means is provided with a winding means for winding the net about itself for purposes of maintaining the net off the floor surface and in close proximity to the first shelf assembly.

20. The method of claim 11, wherein the connecting means is provided with a folding means for folding the net about itself for purposes of maintaining the net off the floor surface and in close proximity to the first shelf assembly.

21. A retractable barrier system that selectively spans an aisle extending between a first shelf assembly and a second shelf assembly, comprising:

a container having a compartment that is accessible via an opening;

a mounting means for mounting the container on the first shelf assembly;

a net;

an anchoring means for anchoring a first end of the net to the container; and a connecting means for connecting an opposite, second end of the net to the container for purposes of storing the net within the container, and for alternatively connecting the second end of the net to the second shelf assembly for purposes of securing the net across the aisle and thereby blocking access to the aisle.

22. The retractable barrier system of claim 21, wherein the container includes a tube, and a door is movably mounted on the tube and selectively blocks the opening.

23. The retractable barrier system of claim 21, wherein the mounting means includes a fastener that extends through aligned openings in the container and the first shelf assembly.

24. The retractable barrier system of claim 23, wherein the fastener is an eye-bolt, and the anchoring means includes a hook that is interconnected between the net and the eye-bolt.

25. The retractable barrier system of claim 21, wherein the connecting means includes a hook mounted on the net and configured to engage the second shelf assembly.

26. The retractable barrier system of claim 25, further comprising an adjusting means for selectively adjusting the hook relative to the net.

27. The retractable barrier system of claim 25, wherein a discrete opening is provided in the container to support the hook when the net is stored within the container.

28. A retractable barrier system that selectively spans an aisle extending between a first shelf assembly and a second shelf assembly, comprising:

a net;

an anchoring means for anchoring a first end of the net to the first shelf assembly; and a connecting means for selectively connecting an opposite, second end of the net to the first shelf assembly for purposes of storing the net off the ground and in close proximity to the first shelf assembly, and for alternatively connecting the second end of the net to the second shelf assembly for purposes of securing the net across the aisle and thereby blocking access to the aisle.

29. The retractable barrier system of claim 28, wherein the anchoring means includes hooks mounted on respective upper and lower corners of the net.

30. The retractable barrier system of claim 29, wherein the connecting means includes hooks adjustably mounted on respective upper and lower corners of the net.

31. The retractable barrier system of claim 28, wherein the connecting means includes hooks adjustably mounted on respective upper and lower corners of the net.

32. A retractable barrier system, comprising:

a first shelf assembly;

a second shelf assembly, wherein an aisle is defined between the second shelf assembly and the first shelf assembly; and a net having a first end anchored to the first shelf assembly, and an opposite, second end that is movable between a storage position, disposed off the ground and in close proximity to the first shelf assembly, and a deployed position, extending across the aisle and thereby blocking access to the aisle.

33. The retractable barrier system of claim 32, further comprising a container mounted on the first shelf assembly and sized and configured to house the net in its storage position.

34. The retractable barrier system of claim 33, wherein the container is a cylindrical tube.

35. The retractable barrier system of claim 34, wherein the tube is provided with a hinged door.

36. The retractable barrier system of claim 35, further comprising a means for latching the door in a closed position.

37. The retractable barrier system of claim 33, wherein the container is provided with a means for supporting the second end of the net in its storage position.

38. The retractable barrier system of claim 32, wherein hooks are mounted on the first end of the net.

39. The retractable barrier system of claim 38, wherein hooks are adjustably mounted on the second end of the net.

40. The retractable barrier system of claim 32, wherein hooks are adjustably mounted on the second end of the net.

41. The retractable barrier system of claim 32, wherein the first end of the net is secured to an elongate rigid member.

42. The retractable barrier system of claim 41, further comprising a means for releasably mounting the rigid member on the first shelf assembly.

43. The retractable barrier system of claim 42, wherein the rigid member is a container sized and configured to house the net in its storage position.

* * * * *